US012305450B1

(12) United States Patent
Peters

(10) Patent No.: US 12,305,450 B1
(45) Date of Patent: May 20, 2025

(54) DOWNHOLE EARTH-BORING ROTARY DRILL BITS COMPRISING CENTER CUTTING MODULES AND RELATED METHODS

(71) Applicant: Baker Hughes Oilfield Operations LLC, Houston, TX (US)

(72) Inventor: Volker Peters, Celle (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/513,416

(22) Filed: Nov. 17, 2023

(51) Int. Cl.
*E21B 10/34* (2006.01)
*E21B 4/02* (2006.01)
*E21B 4/04* (2006.01)

(52) U.S. Cl.
CPC ..... *E21B 10/34* (2013.01); *E21B 4/02* (2013.01); *E21B 4/04* (2013.01)

(58) Field of Classification Search
CPC ..... E21B 10/34; E21B 10/32; E21B 10/325; E21B 10/345; E21B 10/62; E21B 10/633; E21B 10/64
See application file for complete search history.

(56) References Cited

U.S. PATENT DOCUMENTS

| | | | | |
|---|---|---|---|---|
| 4,673,044 | A | 6/1987 | Bigelow et al. | |
| 6,513,594 | B1 * | 2/2003 | McCalvin | E21B 34/10 166/332.3 |
| 10,450,806 | B2 | 10/2019 | Bomidi et al. | |
| 10,697,247 | B2 | 6/2020 | Moss, Jr. et al. | |
| 11,142,959 | B2 | 10/2021 | Schroder et al. | |
| 2011/0079442 | A1 * | 4/2011 | Buske | E21B 10/14 175/336 |
| 2017/0254150 | A1 * | 9/2017 | Stockey | E21B 7/064 |
| 2020/0024906 | A1 * | 1/2020 | Etebu | E21B 10/62 |

* cited by examiner

*Primary Examiner* — Tara Schimpf
*Assistant Examiner* — Jennifer A Railey
(74) *Attorney, Agent, or Firm* — Baker Hughes Company

(57) ABSTRACT

A center cutting module configured for mounting within a body of a downhole earth-boring rotary bit including an elongated body, a module crown secured to a first end of the elongated body, at least one cutting element secured to the module crown, and a drive secured to a second end of the elongated body, wherein the drive causes rotation of the elongated body and the module crown. A downhole earth-boring rotary drill bit including a bit body configured for rotation about a first rotational axis and the center cutting module. Methods of drilling a wellbore within a subterranean formation using the downhole earth-boring rotary drill bit.

20 Claims, 5 Drawing Sheets

DOWNHOLE EARTH-BORING ROTARY DRILL BITS COMPRISING CENTER CUTTING MODULES AND RELATED METHODS

TECHNICAL FIELD

Embodiments of the present disclosure relate generally to earth-boring tools including center cutting elements, as well as related methods of forming downhole tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. The diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

Cutting elements used in earth boring tools often include polycrystalline diamond compact (often referred to as "PCD") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically more efficient at removing formation material within the wellbore the further they are located from the center of the drill bit. The velocity of movement of a cutting element relative to the formation that is located further away from the center of the drill bit is higher than the velocity of a cutting element located near the center of the drill bit. This often results in formation material being removed near the center of the drill bit by a crushing action through pressure of the drill bit moving forward in a linear direction rather than the material being removed by a shearing action through rotation of the cutting elements about the rotational axis of the drill bit. This phenomenon can result in decreased drilling efficiency and damage to cutting elements and the drill bit.

BRIEF SUMMARY

Embodiments of the disclosure include a center cutting module configured for mounting within a body of a downhole earth-boring rotary bit. The center cutting module includes an elongated body, a module crown secured to a first end of the elongated body, at least one cutting element secured to the module crown, and a drive secured to a second end of the elongated body, wherein the drive causes rotation of the elongated body and the module crown.

Another embodiment of the disclosure includes a downhole earth-boring rotary drill bit. The downhole earth-boring rotary drill bit includes a bit body configured for rotation about a first rotational axis and a center cutting module secured within the bit body and rotatable within the bit body about a second rotational axis oriented at an angle relative to the first rotational axis. The center cutting module includes an elongated body, a module crown secured to a first end of the elongated body, at least one cutting element secured to the module crown, and a drive secured to a second end of the elongated body, wherein the drive causes rotation of the elongated body and the module crown.

Another embodiment of the disclosure includes a method of drilling a wellbore within a subterranean formation. The method includes disposing an earth-boring rotary drill bit in a wellbore within the subterranean formation. The drill bit includes a bit body configured for rotation about a first rotational axis and a center cutting module secured within the bit body and rotatable within the bit body about a second rotational axis oriented at an angle relative to the first rotational axis. The center cutting module includes an elongated body, a module crown secured to a first end of the elongated body, at least one cutting element secured to the module crown, a drive secured to a second end of the elongated body, wherein the drive causes rotation of the elongated body and the module crown. The method further includes engaging the drive with the elongated body and rotating the drill bit in the wellbore about the first rotational axis and simultaneously rotating the center cutting module about the second rotational axis.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
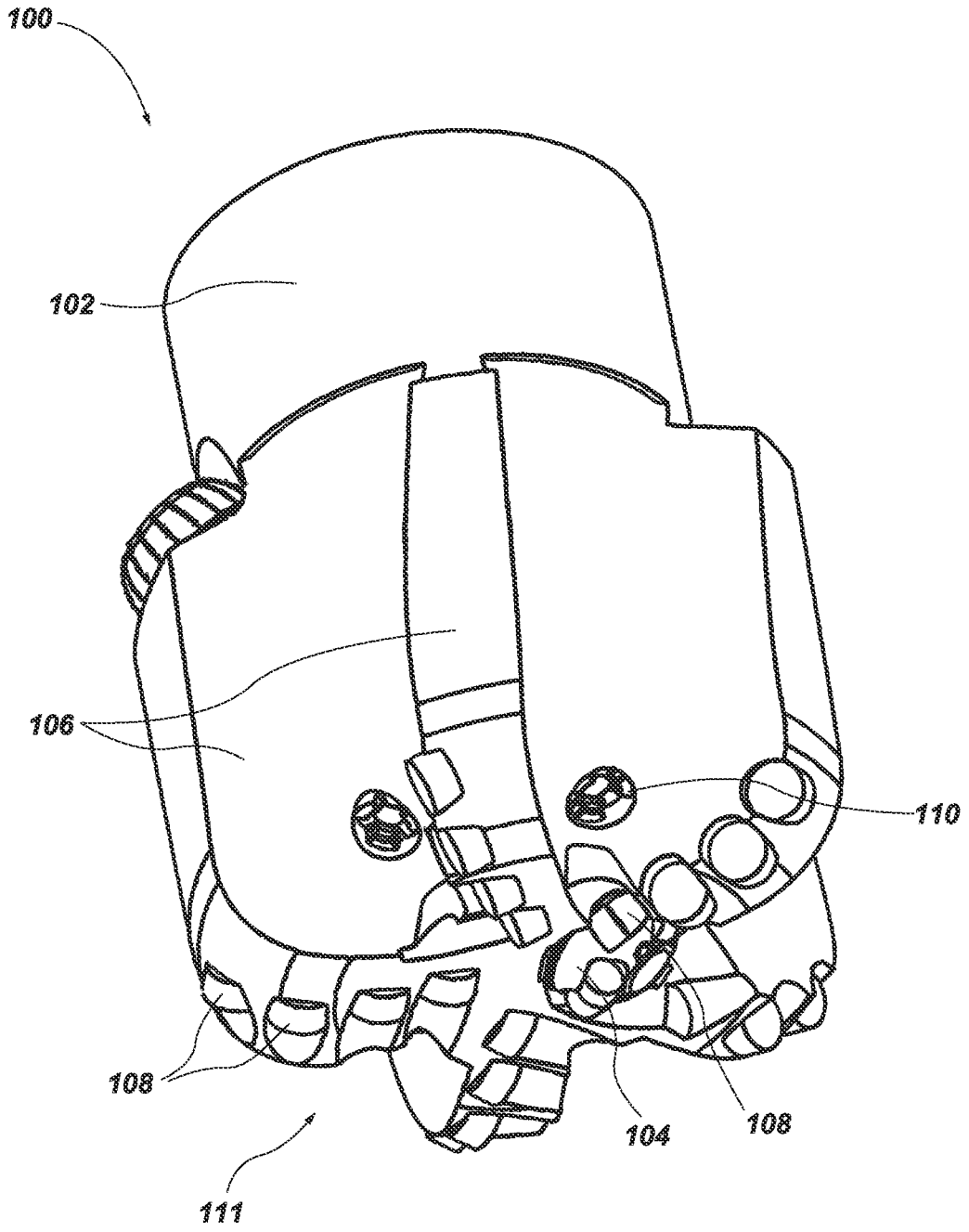
FIG. 1 is a perspective view of a downhole earth-boring rotary drill bit.

The illustrations presented herein are not actual views of any downhole earth-boring rotary drill bit, center cutting module for a drill bit, or any component thereof, but are merely idealized representations, which are employed to describe embodiments of the present invention.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any downhole earth-boring rotary drill bit when utilized in a conventional manner. Furthermore, these terms may refer to an orientation of elements of any downhole earth-boring rotary drill bit as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "and/or" means and includes any and all combinations of one or more of the associated listed items.

Referring to FIG. 1, a perspective view of a downhole earth-boring rotary drill bit 100 is shown. The drill bit 100 may be configured to be operatively connected to a drill string to form part of a bottom-hole assembly (BHA). The drill bit 100 may include a bit body 102 and a center cutting module 104, which is described in further detail below. The bit body 102 may include blades 106, cutting elements 108 secured to the blades 106, and nozzles 110. The cutting elements 108 may be disposed on the blades 106 at a first end 111 of the bit body 102, such that they create a cutting profile of the drill bit 100. At least one cutting element 108 may also be secured to the center cutting module 104. The center cutting module 104 may be disposed within the bit body 102 such that the cutting elements 108 of the center cutting module 104 are located proximate to a center of the first end 111 of the bit body 102 and form at least a portion of the cutting profile of the drill bit 100.

The drill bit 100 is configured to rotate within a wellbore during a drilling operation performed using the drill bit 100. Rotation of the drill bit 100 may be driven by a downhole motor located proximate to the drill bit 100. Alternatively, or in addition, the drill string and the drill bit 100 may be rotated by a drive system located at the surface above a subterranean formation. As the drill bit 100 rotates, the cutting elements 108 contact the subterranean formation within the wellbore and shear or otherwise remove formation material. While drilling, fluid, such as water or drilling mud, is pumped from the surface down through the drill string, through the drill bit 100, and out through the nozzles 110 into the area around the blades 106, and back to the surface through the annular space between the drill string and formation surfaces within the wellbore to aid in removing the sheared formation material and other debris from the wellbore and to cool the cutting elements 108 and the blades 106.

Figure 2:
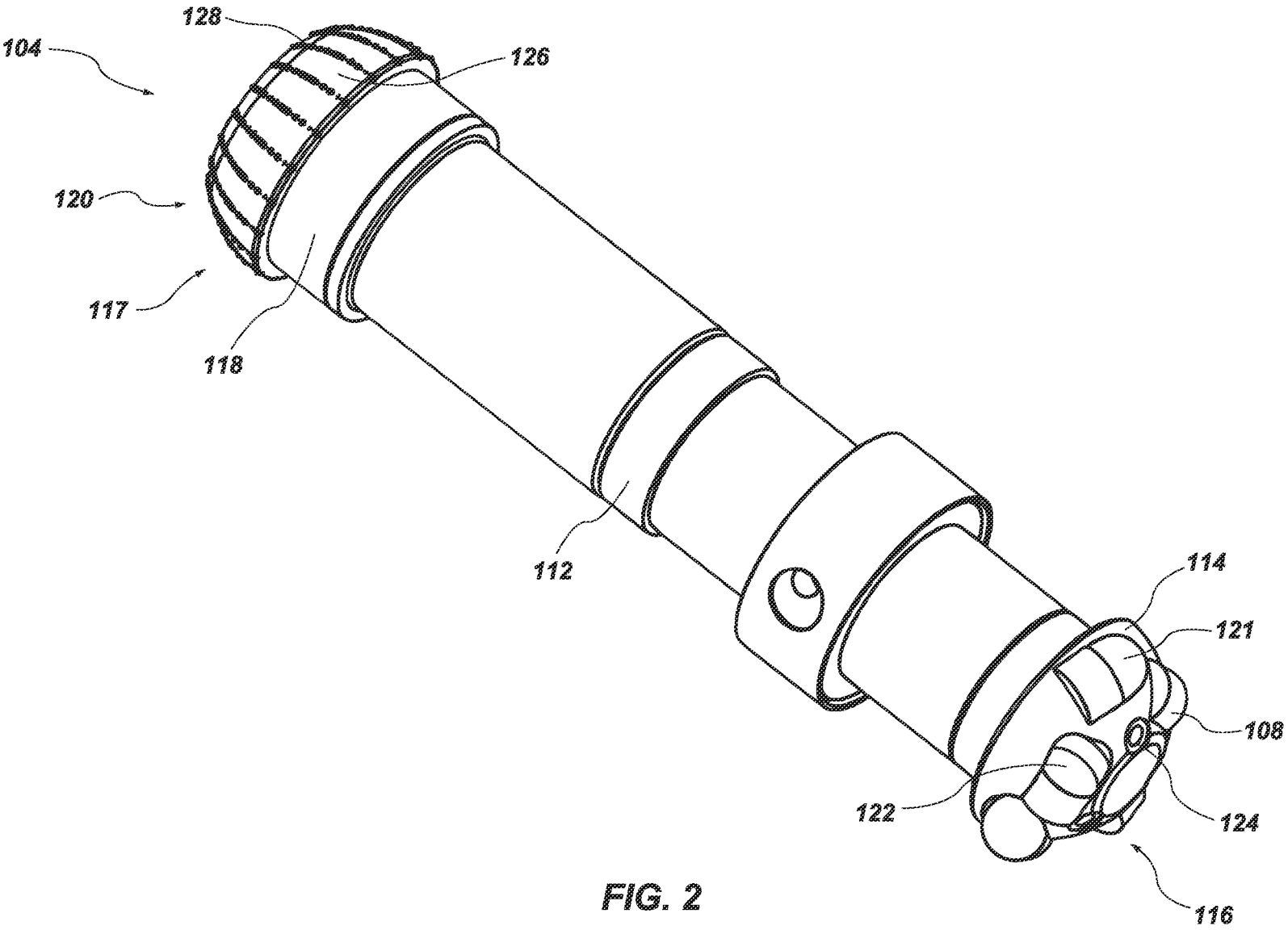
FIG. 2 is a perspective view of a center cutting module.

FIG. 2 illustrates a perspective view of the center cutting module 104. The center cutting module 104 includes an elongated body 112, a module crown 114 secured to a first end 116 of the elongated body 112, at least one cutting element 108 secured to the module crown 114, and a drive 117. The drive 117 may be a friction drive member 118 secured to a second end 120 of the elongated body 112. In some embodiments, the drive 117 may include one or more hydraulic drives, such as turbines, hydrostatic motors, Moineau motors, electric drives, such as electric motors, DC-motors, piezo motors, or any other source of creating the rotation of the center cutting module 104. The center cutting module 104 is configured to be mounted within the bit body 102 of the drill bit 100 in such a manner that, as the drill bit 100 is rotated within the wellbore, the friction drive member 118 will engage the wellbore formation. Friction between the wellbore formation and the friction drive member 118 causes the center cutting module 104 to rotate within and relative to the bit body 102 of the drill bit 100. In some embodiments, the drive 117 may be located internally within the cavity 132 and cause the center cutting module 104 to rotate within and relative to the bit body 102 of the drill bit 100. As the center cutting module 104 rotates within the drill bit 100, the module crown 114 and cutting elements 108 mounted thereon rotate and remove formation material at or near the center of the cutting profile on the cutting face at the first end 111 of the drill bit 100 (FIG. 1).

The module crown 114 of the center cutting module 104 may be removably connected to the elongated body 112. The module crown 114 being removably connected to the elongated body 112 may facilitate easier replacement of components in case of failure or need for maintenance of any components of the drill bit 100. The connection between the module crown 114 and the elongated body 112 may be, for example, a threaded connection. The threaded connection may be configured such that when the drill bit 100 is in operation, the threaded connection is rotated in a direction, tightening the threaded connection between the module crown 114 and the elongated body 112. In some embodiments, the connection between the module crown 114 and the elongated body 112 may be any type of connection that substantially precludes motion of the module crown 114 relative to the elongated body 112. For example, the connection between the module crown 114 and the elongated body 112 may utilize screws, bolts, pins, clips, keys, etc., or any combination thereof. In some embodiments, the module crown 114 may be permanently connected to the elongated body 112 by welding, brazing, or pressing, for example. In some embodiments, the module crown 114 and the elongated body 112 may be integrally formed such that they are each part of a single, unitary structure.

The module crown 114 may include at least one cutting element 108. In some embodiments, the module crown 114 may include multiple cutting elements 108. The cutting elements 108 may be located at least partially within recesses 121. The recesses 121 may be configured to be partially cylindrical and may have sizes and shapes that are substantially complementary to the outer surfaces of the cutting elements 108. The cutting elements 108 may be secured in a fixed manner with the respective recesses 121.

The cutting elements 108 on the bit body 102 may be substantially the same size as the cutting elements 108 on the module crown 114. In some embodiments, the cutting elements 108 on the bit body 102 may be larger or smaller than the cutting elements 108 on the module crown 114 or any combination thereof. The cutting elements 108 may be secured to the module crown 114 by any suitable means, such as brazing, gluing, pressing, etc. In some embodiments, the cutting elements 108 may be integrally formed with the module crown 114 such that they are each part of a single, unitary structure. In some embodiments, (hard or ultrahard, e.g., diamond) the cutting elements 108 may be disposed over the module crown 114 as a grit or fine particle, such as that disclosed in U.S. Pat. No. 4,673,044A, the disclosure of each of which is incorporated herein in its entirety by this reference. Impregnated drill bit crowns typically use embedded hard particles, such as natural diamond or PCD elements. Embedded hard particles, such as natural diamond or PCD elements may be disposed on the module crown 114 by bracing, welding or other suitable techniques.

In some embodiments, the cutting elements 108 may be rotating cutting elements, such as those disclosed in any of U.S. Pat. Nos. 10,450,806, 10,697,247, and 11,142,959, the disclosure of each of which is incorporated herein in its entirety by this reference. The use of such rotating cutting elements 108 may facilitate a more even wear of the cutting faces 122, reduce the maintenance required for the cutting elements 108, and reduce the frequency at which the cutting elements 108 need to be replaced.

The module crown 114 may also include at least one nozzle 124. The nozzle 124 may be used to introduce fluid, such as water or drilling mud, into the area around the module crown 114 to aid in removing the sheared material and other debris from the wellbore, as previously discussed.

The friction drive member 118 may be configured to slide in an axial direction along a longitudinal axis of the elongated body 112 between a retracted first position and an extended second position relative to the elongated body 112, as is described in further detail below with reference to FIG. 3. The friction drive member 118 has an exterior surface 126, which may include at least one feature 128 configured to increase friction between the subterranean formation and the exterior surface 126 of the friction drive member 118. In some embodiments, the feature 128 may be a series and/or pattern of protrusions on the exterior surface 126. In some embodiments, the exterior surface 126 may exhibit a substantially convex shape or may optionally include a combination of curved and at least substantially flat portions. The feature 128 may be one or more roughened areas of the exterior surface 126. The feature 128 may be located on any portion of the exterior surface 126. In some embodiments, the feature 128 may be located on only a portion of the exterior surface 126. In some embodiments, the feature 128 may be a matrix including a grit of hard particles such as tungsten carbide, natural diamond or PCD elements such as those disclosed above. The matrix may be disposed on the exterior surface 126 by means of bracing, welding, or other suitable techniques with the feature 128 protruding from the matrix and forming a friction enhanced surface.

Figure 3:
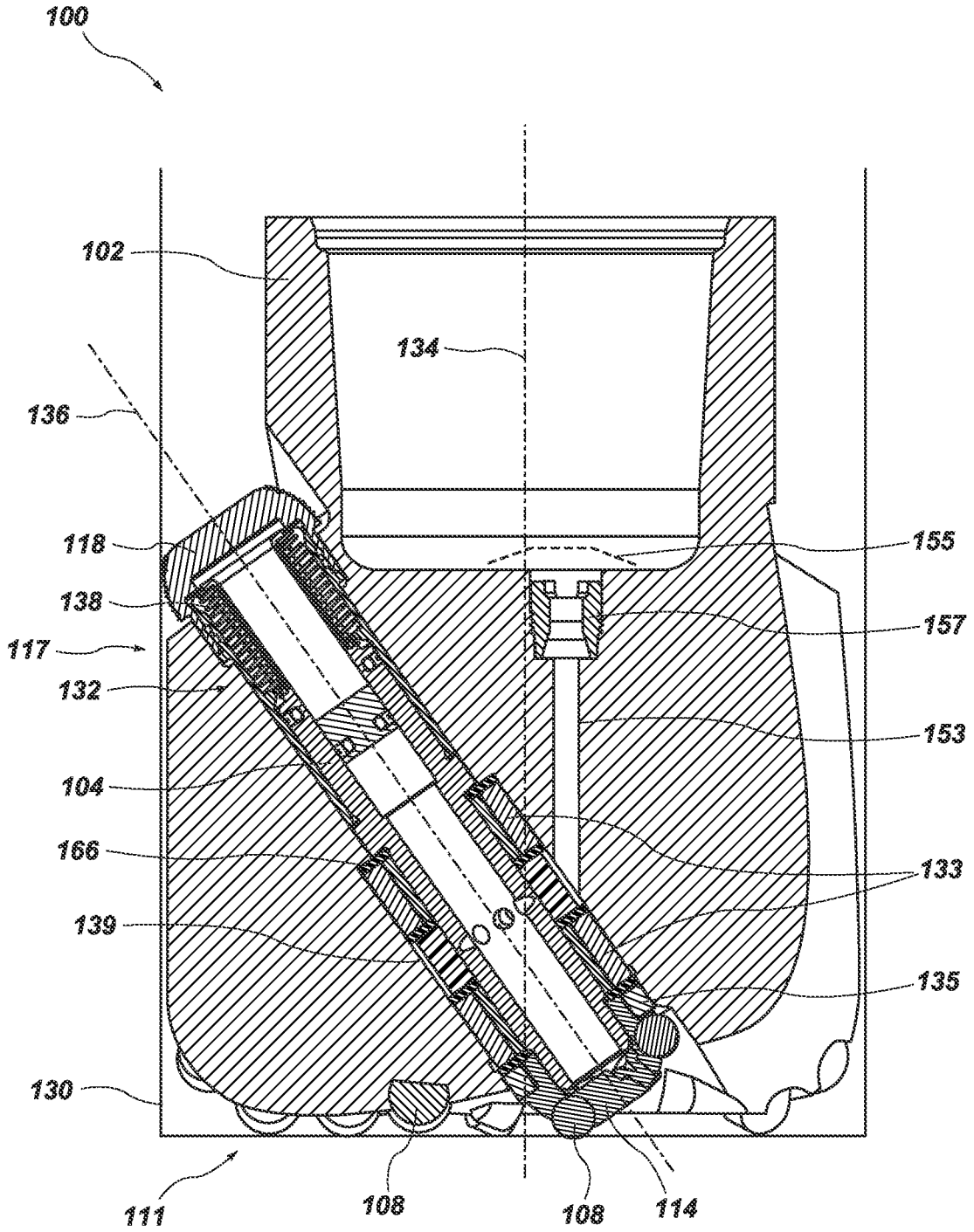
FIG. 3 is cross-sectional, side view of the downhole earth-boring rotary drill bit.

FIG. 3 illustrates a cross sectional view of the drill bit 100 inside a wellbore 130 within a subterranean formation. The bit body 102 may include a cavity 132 extending through a portion of the bit body 102. The bit body 102 may also include at least one stationary bearing 133. The stationary bearing 133 may be configured to support the center cutting module 104 within the cavity 132. The stationary bearing 133 is fixed relative to the bit body 102. A collar 135 may be secured to the first end 111 of the bit body 102. The collar 135 may secure the stationary bearing 133 within the cavity 132. The collar 135 may include a threaded connection to the bit body 102 and compress the stationary bearings 133. The stationary bearings 133 may be separated by a sleeve 139. The collar 135 may be configured to apply a compressive force through the stationary bearings 133 and the sleeve 139 into the bit body 102, applying sufficient clamping to the stationary bearings 133 and the sleeve 139 to fix them relative to the bit body 102. Sleeve 139 includes holes in a radial wall to allow fluid flow from the bit body 102 into the center cutting module 104.

The center cutting module 104 may be disposed within the cavity 132 such that a first rotational (and longitudinal) axis 134 of the bit body 102 is at an angle relative to a second rotational (and longitudinal) axis 136 of the center cutting module 104. The angle of the first rotational axis 134 relative to the second rotational axis 136 may be within a range extending from about 10 degrees to about 70 degrees, more particularly from about 20 degrees to about 50 degrees (e.g., about 35 degrees).

In some embodiments, the first rotational axis 134 of the drill bit 100 may intersect at least a portion of the module crown 114. In some embodiments, the center cutting module 104 may be disposed within the bit body 102 such that the module crown 114 may be located at or at least substantially near the center of the first end 111 of the bit body 102. The cutting elements 108 connected to the module crown 114 may be configured to contact the wellbore 130 at or near a center of the cutting profile of the drill bit 100 and shear or otherwise remove formation material from the wellbore 130.

The cutting elements 108 of the module crown 114 may be configured to facilitate improved (e.g., more efficient) cutting near the center of the wellbore 130. Improving the efficiency of the drill bit 100 at or near the center of the wellbore 130 may provide several benefits. In some embodiments, improved cutting efficiency at or near the center of the wellbore 130 may reduce overall stress on the drill bit 100 caused by crushing of portions of the wellbore 130, which may improve the operational life of the drill bit 100. The improved cutting efficiency may also reduce the amount of fuel or energy required to operate the drill bit 100. The improved cutting may also increase the rate of penetration of the drill bit 100 as compared to traditional drill bits at comparable drilling parameters, such as rotary speed and weight on bit. Since the crushing action of the center rock with traditional drill bits is affecting efficiency in hard rock drilling, the benefits of using the drill bit 100 are expected to be significant when the rock is exceeding a certain hardness and strength (e.g., in geothermal applications).

The bit body 102 may be configured to rotate about the first rotational axis 134. Typically, the bit body 102 is configured to rotate in a clockwise direction about the first rotational axis 134 from the perspective of looking down the wellbore 130. During operation, the drill bit 100 is rotated in only one direction about the first rotational axis 134. The center cutting module 104 is disposed within the bit body 102 such that the friction drive member 118 contacts the surface of the formation within the wellbore 130 during rotation of the bit body 102. Rotation of the bit body 102 about the first rotational axis 134 causes the friction drive member 118 to rotate about the second rotational axis 136 responsive to friction between the formation and the friction drive member 118. The elongated body 112, the module crown 114, and the friction drive member 118 rotate in unison about the second rotational axis 136.

As previously mentioned, the friction drive member 118 may be configured to slide in an axial direction along a longitudinal axis of the elongated body 112 between a retracted first position and an extended second position relative to the elongated body 112. At least one biasing member 138 may be disposed between the friction drive member 118 and the elongated body 112. In some embodiments, the biasing member 138 may be a spring. The biasing member 138 may be configured to bias the friction drive member 118 toward the retracted first position, such that the friction drive member 118 is in the retracted first position when the drill bit 100 is not in operation. The extended second position may be any position in which the friction drive member 118 is displaced in an axial direction along the longitudinal axis of the elongated body 112, away from the module crown 114 and the exterior surface of the bit body 102. As the friction drive member 118 is displaced in an axial direction along the longitudinal axis of the elongated body 112, away from the module crown 114, the friction drive member will be forced into engagement with the formation surface within the wellbore 130. During operation of the drill bit 100, when flow of a fluid through the drill bit 100 occurs, the friction drive member 118 may be extended from the retracted first position to the extended second position, as described further below. The extended second position may allow the friction drive member 118 to maintain friction with the wellbore 130 sufficient to drive rotation of the center cutting module 104 within the bit body 102 of the drill bit 100. The extended second position may vary somewhat due to the unevenness of the formation surface within the wellbore, and the ability of the friction drive member 118 to move along the second rotational axis 136 of the center cutting module 104 may allow the friction drive member 118 to maintain a relatively constant friction force with the wellbore 130, thereby facilitating a relatively constant rotational speed of the center cutting module 104 during drilling.

The friction drive member 118, the module crown 114, and the elongated body 112 may be fixed relative to each other, such that they rotate in unison about the second rotational axis 136. The center cutting module 104 may be configured to rotate in an opposite direction about the second rotational axis 136 (e.g., in the counterclockwise direction from the perspective of looking down the wellbore) relative to the direction at which the bit body 102 rotates about the first rotational axis 134. The angle of the second rotational axis 136 with respect to the first rotational axis 134 and the counterclockwise rotational direction of the center cutting module 104 engages the cutting elements 108 of the module crown 114 in the same relative direction with respect to the earth formation as the cutting elements 108 of the bit body 102, thus preventing any relative backwards motion between cutting elements 108 on the module crown 114 and the bit body 102 and wellbore 130. Cutting elements and especially PCD cutting elements are sensitive to any backwards rotation and easily get damaged when backwards motion occurs.

The center cutting module 104 and the friction drive member 118 have a smaller overall diameter than the bit body 102. As a result, during rotation of the bit body 102, the center cutting module 104 rotates about its axis 136 at a higher rotational speed relative to the rotational speed of the bit body 102 about its axis 134. The higher rotational speed of the center cutting module 104 relative to the rotational speed of the bit body 102 is facilitated because the rotation is picked up by the friction drive member 118 from the location where the largest relative velocity between bit body 102 and wellbore 130 is present. For example, the bit body 102 may rotate at a first rate about the first rotational axis 134 and the center cutting module 104 may rotate at a second rate about the second rotational axis 136. The second rate may be higher than the first rate. In some embodiments, the second rate may be at least about 2 times the first rate. In other embodiments, the second rate may be 3 to 10 times the first rate. The center cutting module 104 operating at the second rate may allow the cutting elements 108 on the module crown 114 to move at a higher speed than they would if they were fixedly mounted to the blades of the bit body 102 at the same location, facilitating the improved cutting efficiency. The ratio of the rotational speed of the center cutting module 104 relative to the rotational speed of the bit body 102 is determined by the ratio of the diameter of the friction drive member 118 relative to the diameter of the wellbore 130 and the bit body 102. A comparably larger diameter of the friction drive member 118 would reduce the rotational speed of the center cutting module 104 but in turn increase the torque capacity of the friction drive member 118 for cutting the formation with cutting elements 108. A comparably smaller diameter of the friction drive member 118 would increase the rotational speed of the center cutting module 104 and decrease the torque capacity of the friction drive member 118 supplied for the center cutting process. Ratio and rotary speed of the center cutting module 104 may be selected to optimize the rock cutting action of the center cutting module 104 and allow for optimized drilling performance of the drill bit 100. In some embodiments, the rotational speed of the center cutting module may be around 4-5 times the rotational speed of the bit body 102, given typical geometrical constraints. The cutting speed of cutting element 108 on the module crown 114 relative to the wellbore 130 may be as high as the cutting speed of the cutting elements 108 that are positioned on the largest radius of bit body 102, thus increasing the efficiency of the cutting of the drill bit 100.

Figure 4:
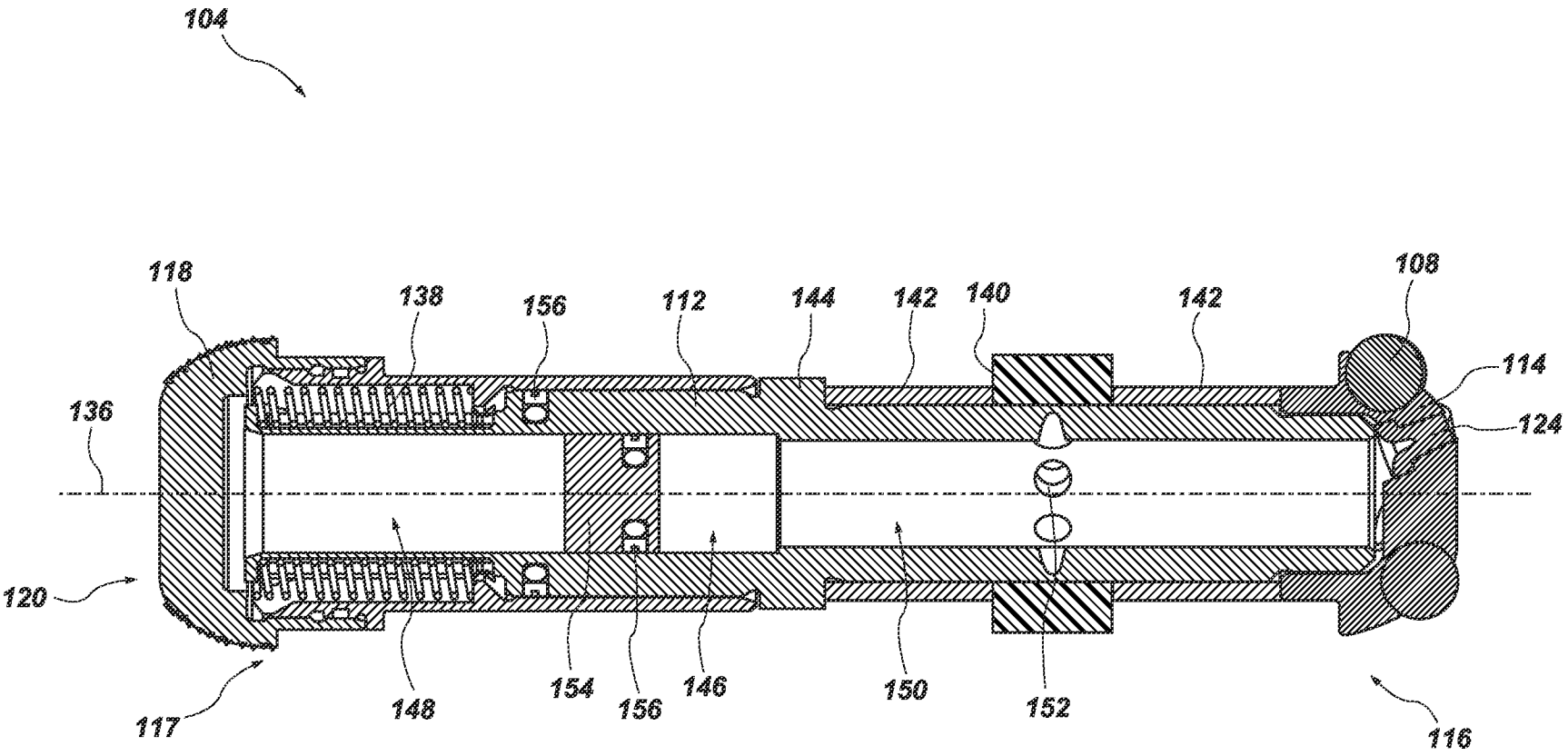
FIG. 4 is a cross-sectional, side view of the center cutting module.

FIG. 4 illustrates a cross sectional view of the center cutting module 104. The center cutting module 104 may further include at least one axial bearing 140 and at least one radial bearing 142. The axial bearing 140 may be configured to allow rotation of the center cutting module 104 about the second rotational axis 136 while precluding axial movement of the elongated body 112 along the second rotational axis 136. The at least one radial bearing 142 may be configured to allow rotation of the center cutting module 104 about the second rotational axis 136 while precluding radial movement of the elongated body 112 perpendicular to the second rotational axis 136. In some embodiments, there may be two or more radial bearings 142. The two or more radial bearings 142 may be located on opposing sides of the axial bearing 140. The axial bearing 140 and the radial bearings 142 may be received over the first end 116 of the elongated body 112. In the present embodiment, the axial bearing 140 and the radial bearings 142 may be located between the module crown 114 and a shoulder 144. In other embodiments, the axial bearing 140 and the radial bearings 142 may be a single bearing or there may be any combination of axial bearings 140 and radial bearing 142. Although journal bearings are shown, any other type, such as roller bearings, PCD bearings or other suitable types of bearings may be used instead. Journal bearings as displayed in FIGS. 2-4 may be made from suitable wear resistant material, such as tungsten carbide, ceramics or suitable metal alloys and combinations thereof. In some embodiments, bearing components may include plastic or rubber elements.

The elongated body 112 may further include an internal cavity 146. The internal cavity 146 may extend through the entire length of the elongated body 112 and may exhibit a substantially cylindrical shape. The diameter of the internal cavity 146 may vary or may be substantially constant. The internal cavity 146 may be divided by a piston 154 into a first fluid cavity 148 and a second fluid cavity 150. The first fluid cavity 148 may be a sealed fluid cavity. The second fluid cavity 150 may be in fluid communication with both the fluid plenum within the bit body 102 and the nozzle 124 in the module crown 114. The elongated body 112 may include at least one fluid port 152 extending radially through the elongated body 112 and in fluid communication with the second fluid cavity 150. In the present embodiment, the fluid port 152 also extends through the axial bearing 140, which may facilitate cooling of the axial bearing 140. In other embodiments, the fluid port 152 may extend through one or more of the radial bearings 142 or may only extend through the elongated body 112. During drilling, the drilling fluid, such as drilling mud, is pumped through the bit body 102, through the fluid port 152, through the fluid cavity 150, and out from the module crown 114 through the nozzle 124.

The piston 154 disposed within the internal cavity 146 divides the internal cavity 146 into the first fluid cavity 148 and the second fluid cavity 150. At least one sealing element 156, such as an O-ring or a gasket, is positioned at the interface between the piston 154 and the interior surface of the elongated body 112 to establish a fluid-tight seal therebetween. An incompressible fluid, such as oil or water, may be disposed within the scaled first fluid cavity 148. In other embodiments, the fluid may be a gas sealed within the first fluid cavity 148.

The piston 154 is configured to slide longitudinally within the internal cavity 146 of the elongated body 112 responsive to differences in fluid pressure on opposing sides of the piston 154 within the first fluid cavity 148 and the second fluid cavity 150. During operation of the drill bit 100, the operating fluid within the second fluid cavity 150 may exert a force upon the piston 154 in a longitudinal direction, toward the second end 120 of the elongated body 112. The force exerted upon the piston 154 is determined by the differential pressure within the second fluid cavity 150 and an annular pressure, external of the drill bit 100. Such differential pressure can be adjusted by selection of the nozzles 110 in the bit body 102, the nozzles 124, and a control nozzle 157. Different sizes of nozzles 110, 124 and the control nozzle 157 may be selected with respect to the expected flow and fluid density during operation of the drill bit 100. As the piston 154 is displaced toward the second end 120 of the elongated body 112, a pressure may be applied to the fluid sealed within the first fluid cavity 148. The fluid pressure exerts a force upon the friction drive member 118 in the longitudinal direction, causing the friction drive member 118 to be displaced from the retracted first position to the extended second position. When the drill bit 100 is in operation in a wellbore 130, displacement of the friction drive member 118 from the retracted first position to the extended second position may cause the friction drive member 118 to come into contact with the surface of the formation within the wellbore 130. Friction between the friction drive member 118 and the formation may increase with increasing displacement of the friction drive member 118 from the retracted first position. The force of friction is controlled by the differential pressure inside second fluid cavity 150 and the annular pressure external of the drill bit 100. Higher differential pressure inside second fluid cavity 150 would cause the friction drive member 118 to come into higher contact pressure with the surface of the formation within the wellbore 130 and thus increasing friction drive torque capacity. The differential pressure inside second fluid cavity 150 can be adjusted to optimum condition with respect to torque capacity, required drive torque for rock cutting, permitted friction contact pressure between the friction drive member 118 and the wellbore 130, radial bearing 142 side load, axial bearing 140 axial load and so forth. In general, selection of the smaller bit nozzles 110 will tend to increase differential pressure inside second fluid cavity 150. Selection of smaller control nozzle 157 will tend to decrease differential pressure inside second fluid cavity 150. Selection of smaller nozzles 124 will tend to increase differential pressure inside second fluid cavity 150.

In other embodiments, there may be no piston 154 to divide the internal cavity 146. The operational fluid may be configured to exert a force upon the friction drive member 118 in a longitudinal direction, away from the second end 120 of the elongated body 112 to displace the friction drive member 118 to the extended second position. It will be appreciated that the hydraulic fluid sealing diameter of seal 156 in combination with the differential pressure inside second fluid cavity 150 controls the friction contact pressure between the friction drive member 118 and the wellbore 130. Larger hydraulic fluid sealing diameter of seal 156 would cause higher contact pressure.

A method of assembling the drill bit 100 may include disposing the elongated body 112 within the cavity 132, securing the friction drive member 118 to the second end 120, and securing the module crown 114 to the first end 116 of the elongated body 112. In some embodiments, the method of assembling the drill bit 100 may further include disposing the piston 154 within the elongated body 112, disposing the biasing member 138 between the friction drive member 118 and the elongated body 112, disposing the at least one axial bearing 140 and the at least one radial bearing 142 over the first end 116 of the elongated body 112, disposing the at least one stationary bearing 133 within the cavity 132, and securing the collar 135 to the first end 111 of the bit body 102.

Figure 5:
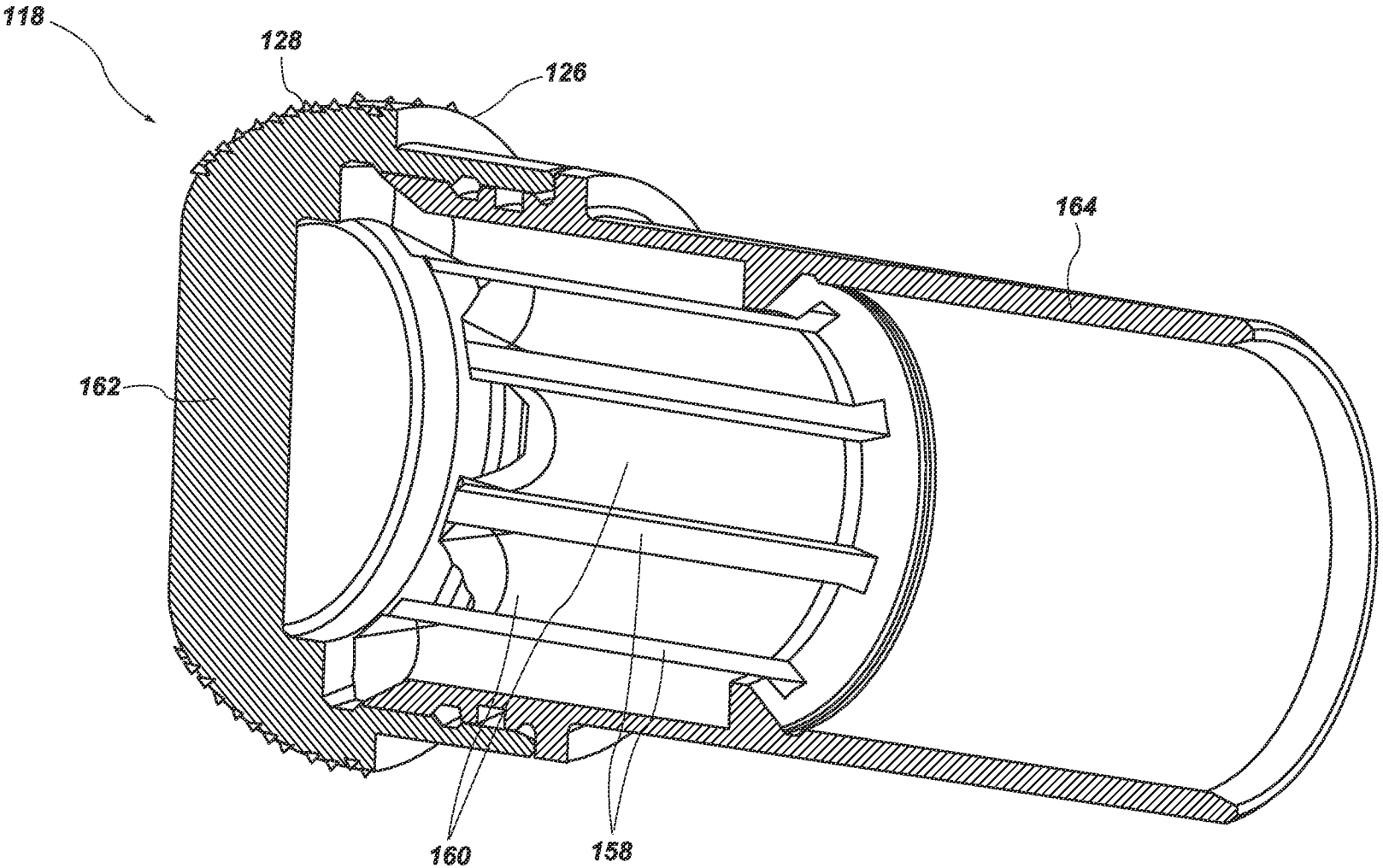
FIG. 5 is a cross-sectional, perspective view of a friction drive member.

FIG. 5 illustrates a perspective, cross-sectional view of the friction drive member 118. The friction drive member 118 may include grooves 158 configured to slidably receive at least a portion of the elongated body 112. The grooves 158 may preclude rotation of the friction drive member 118 relative to the elongated body 112 about the second rotational axis 136 while allowing axial movement of the friction drive member 118 relative to the elongated body 112. The friction drive member 118 may include at least one recess 160 configured to at least partially receive the biasing member 138. In some embodiments, there may be any number of grooves 158 and recesses 160 spaced on the friction drive member 118. In some embodiments, the friction drive member 118 may include a first portion 162 and a second portion 164. The friction drive member 118 may be formed in at least two portions to facilitate assembly of the center cutting module 104. In some embodiments, the biasing member 138 may be received within the recess 160 prior to the second portion 164 being secured to the first portion 162. The connection between the first portion 162 and the second portion 164 may be a threaded connection and may be a sealed, fluid-tight connection.

In some embodiments, the drill bit 100 may include gears, such as planetary gears or spur gears, to rotate the center cutting module 104 relative to the bit body 102. Gears can also be used to achieve desired rotational direction of the center cutting module 104 with respect to the formation. In some embodiments, at certain inclined angles of the second rotational axis 136 with respect to the first rotational axis 134, it may be desirable to change the rotational direction of the center cutting module 104 using gears. In other embodiments, it may be required to increase or decrease the rotary speed of the center cutting module 104 through use of gears and/or a gearbox.

In some embodiments, the center cutting module 104 may include at least one seal 166. The at least one seal 166 is configured to seal the axial bearing 140, radial bearing 142 and/or the stationary bearing 133 from the drilling fluid and seal a lubricant with the axial bearing 140, radial bearing 142 and/or the stationary bearing 133. The at least one seal 166 may include radial shaft seals and/or axial face seals. The seals 166 may increase bearing life and reduce bearing friction. The axial bearing 140, radial bearing 142 and/or the stationary bearing 133 may be more efficient when sealed and lubricated.

In some embodiments, engaging the friction drive member 118 with the wellbore 130 may be done in an alternative manner, e.g., by using biasing means to extend and engage the friction drive member 118 with the wellbore 130. Those biasing means may utilize springs, compressed fluid or gas, or other structural elements, ensuring intimate contact with the wellbore 130.

A control nozzle 157 is shown in FIG. 3 to facilitate control of the pressure inside second fluid cavity 150. A filter screen 155 may be provided to avoid potential blockage of the fluid passageways 153, 152, 124. In some embodiments, the nozzles 110 of drill bit 100 have a larger internal diameter than the one or more of the fluid passageways 153, 152, 124. Larger particles may block fluid passageways 153, 152, 124. To avoid such blockage, the filter screen 155 can be used before operating fluid passes through the control nozzle 157. The filter screen and or the control nozzle 157 can be directed in a way that the main flow, flowing through the main nozzles 110, flushes away debris and further prevents any particle accumulation and fluid path blockage.

A method of drilling the wellbore 130 within the subterranean formation may comprise disposing the drill bit 100 in a wellbore 130 within the subterranean formation, engaging the friction drive member 118 with a surface of the formation within the wellbore 130, rotating the drill bit 100 in the wellbore 130 about the first rotational axis 134, and simultaneously rotating the center cutting module 104 about the second rotational axis 136.

Engaging the friction drive member 118 with the wellbore 130 may further comprise moving the friction drive member 118 in an axial direction relative to the elongated body 112. Moving the friction drive member 118 in an axial direction relative to the elongated body 112 may further comprise increasing a fluid pressure within the elongated body 112. Rotating the bit body 102 in the wellbore 130 about the first rotational axis 134 and simultaneously rotating the center cutting module 104 about the second rotational axis 136 may further comprise rotating the bit body 102 in the wellbore 130 in a first rotational direction and simultaneously rotating the center cutting module 104 about the second rotational axis 136 in a second rotational direction, opposite the first rotational direction.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A center cutting module configured for mounting within a body of a downhole earth-boring rotary bit, comprising:

an elongated body;

a module crown secured to a first end of the elongated body;

at least one cutting element secured to the module crown; and a drive secured to a second end of the elongated body, wherein the drive causes rotation of the elongated body and the module crown.

2. The center cutting module of claim 1, wherein the drive is a friction drive member, wherein the friction drive member is configured to slide in an axial direction along a longitudinal axis of the elongated body between a retracted first position and an extended second position relative to the elongated body.

3. The center cutting module of claim 2, further comprising a biasing member configured to bias the friction drive member toward the retracted first position.

4. The center cutting module of claim 3, wherein the biasing member comprises a spring disposed between the friction drive member and the elongated body.

5. The center cutting module of claim 2, wherein a first fluid cavity is a sealed fluid cavity, and wherein the center cutting module further comprises a fluid within the first fluid cavity.

6. The center cutting module of claim 5, further comprising:

an internal cavity in the elongated body; and a piston disposed within the internal cavity and configured to slide longitudinally within the internal cavity in the elongated body, the piston dividing the internal cavity into a first fluid cavity and a second fluid cavity.

7. The center cutting module of claim 6, further comprising at least one fluid port extending radially through the elongated body and in fluid communication with the second fluid cavity.

8. The center cutting module of claim 1, further comprising:

at least one radial bearing configured to allow rotation of the center cutting module about a longitudinal axis of the elongated body while precluding radial movement of the elongated body perpendicular to the longitudinal axis of the elongated body; and at least one axial bearing configured to allow rotation of the center cutting module about the longitudinal axis of the elongated body while precluding axial movement of the elongated body along the longitudinal axis of the elongated body.

9. The center cutting module of claim 1, wherein the elongated body, the module crown, the at least one cutting element, and the drive are configured to rotate about a longitudinal axis of the elongated body in unison.

10. The center cutting module of claim 1, wherein the drive is a friction drive member, an exterior surface of the friction drive member including at least one feature configured to increase friction between the subterranean formation and the exterior surface of the friction drive member.

11. A downhole earth-boring rotary drill bit, comprising:

a bit body configured for rotation about a first rotational axis; and a center cutting module secured within the bit body and rotatable within the bit body about a second rotational axis oriented at an angle relative to the first rotational axis, the center cutting module comprising:

an elongated body;

a module crown secured to a first end of the elongated body;

at least one cutting element secured to the module crown; and a drive secured to a second end of the elongated body, wherein the drive causes rotation of the elongated body and the module crown.

12. The drill bit of claim 11, wherein the drive is a friction drive member, wherein the friction drive member is configured to slide in an axial direction along a longitudinal axis of the elongated body between a retracted first position and an extended second position relative to the elongated body.

13. The drill bit of claim 12, wherein the center cutting module further comprises a biasing member configured to bias the friction drive member toward the retracted first position.

14. The drill bit of claim 11, wherein the angle is in a range extending from 20 degrees to 50 degrees.

15. The drill bit of claim 11, wherein the center cutting module and the bit body are configured to rotate opposite directions about their respective axis.

16. The drill bit of claim 11, wherein the drive is one of a hydraulic drive or an electric drive.

17. A method of drilling a wellbore within a subterranean formation, comprising:

disposing an earth-boring rotary drill bit in the wellbore within the subterranean formation, the drill bit comprising:

a bit body configured for rotation about a first rotational axis; and a center cutting module secured within the bit body and rotatable within the bit body about a second rotational axis oriented at an angle relative to the first rotational axis, the center cutting module comprising:

an elongated body;

a module crown secured to a first end of the elongated body;

at least one cutting element secured to the module crown; and a drive secured to a second end of the elongated body, wherein the drive causes rotation of the elongated body and the module crown;

engaging the drive with the elongated body; and rotating the drill bit in the wellbore about the first rotational axis and simultaneously rotating the center cutting module about the second rotational axis.

18. The method of claim 17, wherein engaging the drive with the elongated body comprises:

moving a friction drive member in an axial direction relative to the elongated body; and engaging the friction drive member with a surface of the subterranean formation.

19. The method of claim 18, wherein moving the friction drive member in the axial direction relative to the elongated body comprises increasing a fluid pressure within the elongated body.

20. The method of claim 17, wherein rotating the bit body in the wellbore about the first rotational axis and simultaneously rotating the center cutting module about the second rotational axis comprises rotating the bit body in the wellbore in a first rotational direction and simultaneously rotating the center cutting module about the second rotational axis in an opposite second rotational direction.

* * * * *